United States Patent [19]

Kanbe

[11] 4,378,158

[45] Mar. 29, 1983

[54] DEVELOPING APPARATUS

[75] Inventor: Junichiro Kanbe, Tokyo, Japan

[73] Assignee: Canon Kabushiki Kaisha, Tokyo, Japan

[21] Appl. No.: 167,346

[22] Filed: Jul. 10, 1980

[30] Foreign Application Priority Data

Jul. 16, 1979 [JP] Japan ..... 54-91160

[51] Int. Cl.[3] ..... G03G 15/09; G03G 15/00; G03G 13/09

[52] U.S. Cl. ..... 355/3 DD; 355/14 D; 118/625; 118/628; 118/644; 118/647; 118/648; 118/651

[58] Field of Search ..... 355/3 DD, 14 D, 3 R, 355/14 R, 15; 118/657, 658, 621, 624, 625, 628, 644, 647, 648, 651, 652; 430/122

[56] References Cited

U.S. PATENT DOCUMENTS

| | | | |
|---|---|---|---|
| 3,152,012 | 10/1964 | Schaffert | 118/637 |
| 3,929,098 | 12/1975 | Liebman | 355/3 DD X |
| 3,950,089 | 4/1976 | Fraser et al. | 355/3 DD |
| 3,990,394 | 11/1976 | Katakura | 118/658 |
| 3,996,892 | 12/1976 | Parker et al. | 118/658 |
| 4,036,175 | 7/1977 | Phillips et al. | 355/3 DD X |
| 4,194,828 | 3/1980 | Hölz et al. | 355/3 DD |
| 4,230,070 | 10/1980 | Murasaki et al. | 355/3 DD X |
| 4,292,387 | 9/1981 | Kanbe et al. | 355/3 DD X |

*Primary Examiner*—A. C. Prescott

*Attorney, Agent, or Firm*—Fitzpatrick, Cella, Harper & Scinto

[57] ABSTRACT

A developing apparatus used to develop the latent image on the latent image holding body, which has a developing agent holding roller established in proximity or in contact with the latent image holding body and a developing agent supplying roller which supplies the developing agent to the developing agent holding roller. The developing agent supplying roller is arranged with a gap against the developing agent holding roller and to this gap an electric field is applied to deliver the developing agent from the one to the other.

30 Claims, 5 Drawing Figures

DEVELOPING APPARATUS

BACKGROUND OF THE INVENTION

1. Field of the Invention

This invention relates to a developing apparatus for an electrostatic latent image or more particularly to a dry type developing apparatus in which single constituent developing agents are used.

2. Description of the Prior Art

Recently the developing methods using single constituent developing agent have been considered to be superior to the conventional 2 constituent developing methods from the points of view of their simplicity, durability, good picture quality, etc. and studies to develop good developing methods are underway. Especially the developing method using insulating toner is spotlighted in that it enables plain paper transcription to be made by the use of corona discharge.

For example, in U.S. patent application Ser. Nos. 58,434 now abandoned and 58,435 now U.S. Pat. No. 4,292,387 by this assignee, examples of apparatus which perform development using such single insulating developing agent are shown. In the developing method using such insulating toner, visualization of latent image is made by coating single constituent developing agent consisting of insulating toner on the toner holding body and making said toner holding body approach or contact the latent image forming body. This method had a great technical problem in the process of coating a thin and uniform toner layer onto the toner holding body. For example, the method in which an elastic coating blade is made to contact with the toner holding body to form a thin toner layer with the travel of the toner holding body is known. However, in this method foreign bodies or condensated toner are easy to block the gap between the elastic coating blade and toner holding body. This gave bad influence on the developed picture by generating white stripes on the section of the toner holding body where the toner was absent. Moreover, the thickness of the toner layer was varied delicately by the contact pressure of the elastic coating blade, resulting in hard control of developing density.

SUMMARY OF THE INVENTION

An object of this invention is to offer a developing apparatus which overcomes such important problems in the developing method using single constituent insulating developing agent. Another object of this invention is to offer a developing apparatus capable of coating single constituent developing agent uniformly on the surface of the developing agent holding means.

Still another object of this invention is to offer a developing apparatus in which the developing density can be varied by controlling the thickness of the developing agent layer on the developing agent holding means.

This invention which meets the above-mentioned objects is a developing apparatus having a developing agent holding means which holds the developing agent layer on the surface and which rotates, a developing agent supplying means which supplies developing agent to said developing agent holding means and which is established facing the above-mentioned developing agent holding means with a gap in between, and a means of forming an electric field in the gap between the developing agent holding means and the developing agent supplying means to perform delivery of the developing agent between them. It is also a developing apparatus which has the means of controlling the developing agent layer on the developing agent holding means such as the means for varying the voltage applied across the developing agent holding means and the developing agent supplying means or the means for varying the relative shifting speeds of both at the close standing positions of both.

The above-mentioned and other objects and features of the invention will be more clear by reading the following detailed description, referring to the appended drawings.

DESCRIPTION OF THE PREFERRED EMBODIMENTS

Figure 1:
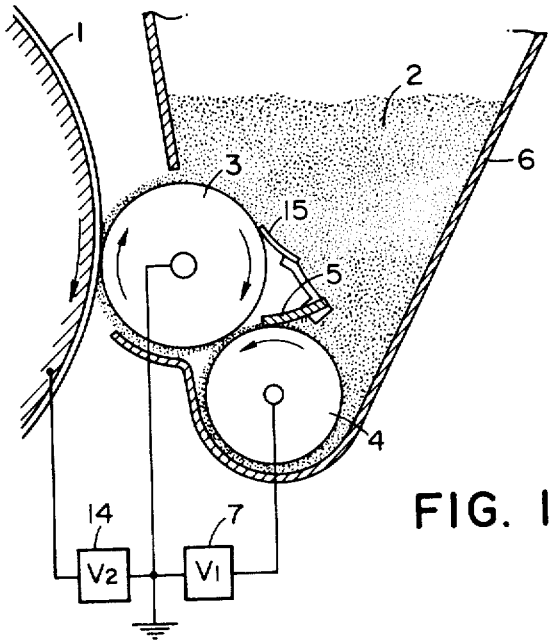
FIG. 1 is the cross sectional view of the developing apparatus showing one embodiment of this invention.

The embodiments of this invention will now be described referring to the drawings.

Figure 3:
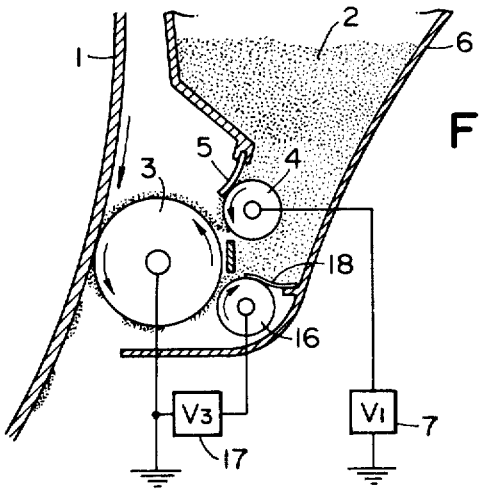
FIG. 3 is the cross sectional view of the developing apparatus showing still other embodiment of this invention.

In FIG. 1, 1 is the latent image forming means, 2 is the insulating toner regarded as single constituent developing agent, 3 is the toner holding means, 4 is the toner supplying means, and 5 is the toner coating means. The latent image forming means 1 is, for example, an electrophotographic light sensitive body drum in an electrophotographic device which rotates for example clockwise as shown in the drawing. Conductive rollers, belts, etc. are used as the toner holding means 3 and toner supplying means 4. Both means are made to face each other through infinitesimal space. Although in FIG. 1, the roller 3 is made to rotate clockwise and the roller 4 is made to rotate counterclockwise, or in the reverse directions with each other, they can be made to rotate in the same direction as shown in FIG. 3. As the toner coating means 5 an elastic blade made of rubber etc. is used preferably, this is made to contact, for example, with the roller 4.

The single constituent developing agent (insulating toner) 2 is accommodated in the container 6 and the toner 2 is applied from the container 6 to the supply roller 4. Due to the friction, the toner is given electric charges reverse in polarity to the picture area potential of the electrostatic image. In this phase, non-uniform coatings such as white stripes are easy to occur on the toner layer formed on the supply roller 4 by the blade 5, caused by the blocking of the gap between the blade 5 and the roller 4 with foreign bodies or condensated toner. In any case, the toner on the supply roller 4 is shifted to the holding roller 3 at the above-mentioned gap. The supply roller 4 and the holding roller 3 are made to face each other by way of the gap as mentioned above and the minimum gap width is greater than the thickness of the toner layer formed on the roller 4 by the blade 5. Accordingly, in order to transfer the toner to the holding roller 3 at the gap section, an electric field is formed across the rollers 3 and 4 by the power supply 4. Of course the direction of the electric field is such that it can pull the charged toner mentioned above from the roller 4 toward the roller 3 electrostatically. In this way the toner jumps from the roller 4 side to stick to the surface of the roller 3 to form a toner layer used to developing the electrostatic image. And the toner layer is formed thin and uniform. The toner has electric charge caused by the friction between the toner and the blade 5, between the roller 4 and the toner, or among the toner gains. In the case of a toner which has a low resistance, electric charges can be injected by using a charge injecting electrode.

Although the electric field between the rollers 3 and 4 which is caused by the power supply 7 can be a DC field, if an AC field is used instead of the DC field, the following merits are generated.

By an AC field the toner is made to travel back and forth or agitated violently in the above-mentioned gap section and the nonuniformity in the toner coating generated on the supply roller 4 can be almost nullified on the holding roller 3. Moreover, an effect to prevent the transfer of the toner having small charge or having extraordinary grain diameter from the supply roller to the holding roller 3 and to select a proper toner and apppy it to the holding roller is generated.

The holding roller 3 supplies the toner layer that has been formed as described above to the light sensitive body 1 at the developing section to develop the electrostatic latent image.

The developing characteristic is more favorable the shorter the distance between the light sensitive body 1 and the roller 3 and the roller 3 can be made to contact with the light sensitive body by forming at least the surface layer of the member 3 with an elastic body such as conductive rubber.

Figure 2:
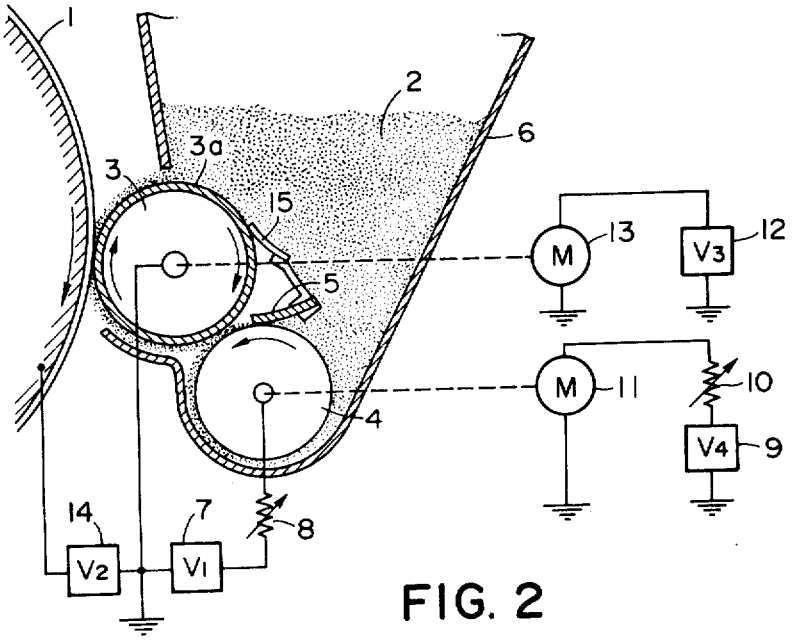
FIG. 2 is the cross sectional view of the developing apparatus showing another embodiment of this invention.

FIG. 2 shows the cross sectional view of a modified embodiment of this invention in which as an example the surface layer of the developing agent holding roller is formed with conductive rubber 3*a* and is arranged to contact with the light sensitive body 1.

Other elements which are also found in the apparatus shown in FIG. 1 have the same symbols. Moreover, since the thickness of the toner layer on the toner holding roller 3 has a great influence on the developing density, the thickness of the toner layer can be made adjustable freely by controlling the output of the power supply 3 using the output adjusting means 8 or by varying the relative rotating speeds of the rollers 3 and 4.

This is attained by varying for example the output of the power supply 9 by using the output adjusting means 10 to vary the revolutions of the motor 11 as shown in the drawing. Of course various other means to vary the relative speeds of both rollers such as to vary the rotating speed of the drive motor 13 of the roller 3 by varying the output of the power supply 12 can be thought of easily. It is desirable to a form fog preventing electric field between the holding roller 3 which supplies the toner to the light sensitive body 1 and the light sensitive body 1 by using the power supply 14. In the way the toner that has not been consumed by the developing section but which remains on the holding roller is scraped off in the container 6 by the scraper 15 which is in contact with the roller 3 and recovered in the container 6 unchanged.

FIG. 3 shows another embodiment of this invention. The most different point of the embodiment compared with the embodiment shown in FIG. 1 is that instead of making elastic scraping member 15 as shown FIG. 1 contact with the holding roller 3 as the means of removing the toner remaining on the toner holding roller 3 after ending development, the roller 16 made of conductive body such as metal is arranged in proximity to the holding roller 3 and an electric field is applied across the rollers 3 and 16 by the power supply 17 to remove the toner with this electric field. The direction of this electric field is of course formed in the direction to attract the toner from the holding roller 3 to the removing roller 16.

To prevent the condensation of the toner it is desirable for the rollers 3 and 16 to rotate at the same speed and in the same direction at the proximity section. In this embodiment the output voltage was a DC voltage. It is allowed to superimpose an AC component on it.

The toner that has been transferred from the holding roller 3 to the metal roller 16 is scraped off by the elastic plate 18 and stays in the container 6 unchanged until it is reused. The advantage of such removal of toner by an electric field is that it does not damage the surface of the holding roller.

The fog preventive effect is obtained by forming an electric field between the toner holding roller 3 and the light sensitive body similar to the embodiment shown in FIG. 1 or FIG. 2.

Next, the examples of experiment made on the embodiment of FIG. 1 based on concrete numerical values will be shown.

The toner 2 was made by mixing and kneading 90 parts of polysterene, 7 parts of carbon black and adding 0.2 wt % of colloidal silica to the powdered mixture. 3 and 4 are conductive rubber rollers. 5 is an urethane rubber blade of 2 mm in thickness. The rollers 4 and 3 are held having about 0.5 mm of shortest distance in between (The range from 0.5 mm to 1 mm is desirable.), and a voltage formed by supperimposing a −500 V DC component to a sine wave, 1 KHz in frequency and 2000 V in amplitude, is applied across the rollers 3 and 4. (The coating layer becomes more uniform when the amplitude and/or frequency are increased.) Experiment was made under those conditions and a charged toner layer, thin and very uniform, was established on the roller 3. The roller 3 makes contact with the latent image forming body 1 to develop the latent image. At this time an AC voltage is applied across the roller 3 and the back electrode of the latent image forming body 1 by the power supply 14. The frequency of the AC voltage is 400 Hz and the amplitude is 1500 V and a −200 V DC voltage is superimposed to the back electrode side.

The latent image potential is 500 V at picture section and 0 V at no-picture section. By applying such an alternating electric field at time of development, the picture having proper edge effect and being hard to generate fog was obtained.

Figure 4:
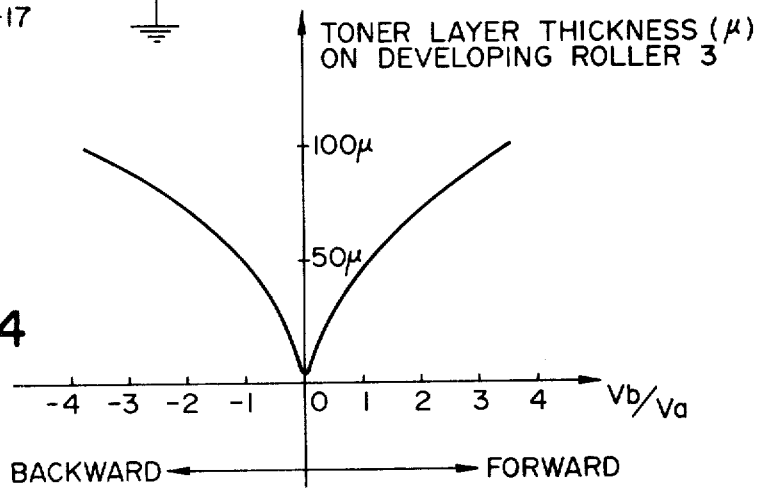
FIG. 4 is the graph showing the changes in the thickness of the toner layer when the relative speed of the developing agent holding roller and the developing agent supplying roller is changed.

Experiments were made on the apparatus having the various factors mentioned above by varying the relative speed between the rollers 3 and 4. It was found that the thickness of the toner layer formed on the roller 3 varied as shown in FIG. 4. In FIG. 4, Vb/Va means (speed of roller 4)/(speed of roller 3). The term forward rotation means that the rollers 3 and 4 rotate in the direction shown in FIG. 4, that is the roller 3 rotates clockwise and the roller 4 counterclockwise and the backward rotation means that the rollers 3 and 4 rotate in the direction reverse to that shown in FIG. 1, or when the roller 3 rotates clockwise, the roller 4 also rotates clockwise and when the roller 3 rotates counterclockwise, the roller 4 also rotates counterclockwise.

Figure 5:
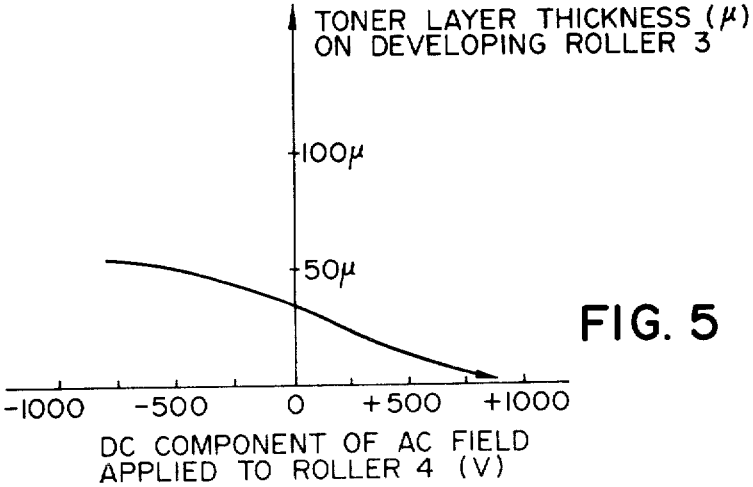
FIG. 5 is the graph showing the changes in the thickness of the toner layer when the DC component of the AC voltage applied to the developing agent supplying roller is changed.

It is also allowed to vary the output of AC voltage 7 to control the thickness of the toner layer on the roller 3. FIG. 5 shows the results of experiments in the apparatus having various factors described above. As seen clearly from the drawing the thickness of the toner layer on the roller 3 can be varied by varying the DC component of the AC voltage. As was mentioned before, the developing density can be controlled by controlling the thickness of the toner layer on the roller 3 in this way.

As has been described so far, according to this invention a good quality picture free of nonuniform development can be obtained since a thin and uniform layer of single constituent developing agent can be obtained easily.

Moreover, since the thickness of the layer can be controlled accurately, a toner image having a good picture quality can be obtained by varying the developing density.

What I claim is:

1. A developing apparatus for developing a latent image by applying one component developing agent to a latent image holding body comprising:

developing agent holding means for holding the developing agent on the surface thereof and carrying it to a developing station;

developing agent supply means for supplying the developing agent to said developing agent holding means, said developing agent supplying means being positioned to face said developing agent holding means with a gap therebetween;

means for limiting the thickness of the layer of developing agent formed on said developing agent supplying means to be less than the gap between said developing agent holding means and said developing agent supplying means so as to form a clearance between said developing agent holding means and the layer of developing agent; and means for applying an AC voltage across the gap between said developing agent holding means and developing agent supplying means to cause the developing agent to fly from said developing agent supplying means to said developing agent holding means across the clearance.

2. A developing apparatus as set forth in claim 1 in which said applying means applies an AC voltage on which a DC voltage is superimposed.

3. A developing apparatus as set forth in claim 1, further comprising coating means to apply the developing agent to said developing agent supplying means.

4. A developing apparatus as set forth in claim 3 in which said coating means is an elastic blade made to contact with said developing agent supplying means.

5. A developing apparatus as set forth in claim 1, further comprising means for forming an electric field to prevent fogging between the latent image holding body and said developing agent holding means.

6. A developing apparatus as set forth in claim 1 in which said developing agent holding means has at least the surface composed of an elastic body and is made to contact with the latent image holding body.

7. A developing apparatus as set forth in claim 1 in which said developing agent holding means is formed with conductive material.

8. A developing apparatus as set forth in claim 1 further comprising means for removing the developing agent which remains on said developing agent holding means after developing the latent image.

9. A developing apparatus as set forth in claim 8 in which said developing agent removing means is an elastic plate made to contact with said developing agent holding means.

10. A developing apparatus as set forth in claim 8 in which said developing agent removing means is a conductive roller placed close to said developing agent holding means, and further including means for applying an electric field across said developing agent holding means and said conductive roller to attract the developing agent from said developing agent holding means to said conductive roller.

11. A developing apparatus as set forth in claim 10 in which the above-mentioned conductive roller is rotatable at the proximity section against said developing agent holding means in the same direction and at the same speed as said holding means.

12. A developing apparatus as set forth in claim 10 or 11, further comprising an elastic plate used to scrape off the developing agent which has moved to said conductive roller.

13. A developing apparatus for developing a latent image by applying one component developing agent to a latent image holding body comprising:

developing agent holding means for holding the developing agent on the surface thereof and carrying it to a developing station;

developing agent supplying means for supplying developing agent to said developing agent holding means, said developing agent supplying means being positioned to face said developing agent holding means with a gap therebetween;

means for limiting the thickness of the layer of developing agent formed on said developing agent supplying means to be less than the gap between said developing agent holding means and said developing agent supplying means so as to form a clearance between said developing agent holding means and the layer of developing agent;

means for forming an AC electric field in the gap between said developing agent holding means and developing agent supplying means to cause the developing agent to fly from said developing agent supplying means to said developing agent holding means across the clearance; and means for controlling the thickness of the developing agent layer on said developing agent holding means.

14. A developing apparatus as set forth in claim 13 in which said control means for the thickness of the developing agent layer is a means for controlling the applied voltage used to form the electric field.

15. A developing apparatus as set forth in claim 13 in which said control means for the thickness of the developing agent layer is a means of controlling the relative movement speed of said developing agent holding means and said developing agent supplying means.

16. A developing apparatus as set forth in claim 13 in which said electric field forming means forms an AC electric field by an AC voltage to which a DC voltage is superimposed.

17. A developing apparatus as set forth in claim 13, further comprising coating means to coat the developing agent on said developing agent supplying means.

18. A developing apparatus as set forth in claim 17 in which said coating means is an elastic blade made to contact with said developing agent supplying means.

19. A developing apparatus as set forth in claim 13, further comprising means for forming an electric field between the latent image holding body and said developing agent holding means for prevention of fog formation.

20. A developing apparatus as set forth in claim 13 in which at least the surface of said developing agent holding means is formed with an elastic body which is made to contact with the latent image holding body.

21. A developing apparatus as set forth in claim 13 in which said developing agent holding means is formed with conductive material.

22. A developing apparatus as set forth in claim 13, further comprising means for removing the developing agent remaining on said developing agent holding means after developing the latent image.

23. A developing apparatus as set forth in claim 22 in which said developing agent removing means is a elastic plate made to contact with said developing agent holding means.

24. A developing apparatus as set forth in claim 22 in which said developing agent removing means is a conductive roller arranged in proximity to said developing agent holding means and further comprising means for applying an electric field across said developing agent holding means and conductive roller to attract the developing agent from said developing agent holding means to said conductive roller.

25. A developing apparatus as set forth in claim 24 in which said roller is rotatable in the same direction and at the same speed as said holding means at the proximity section to said developing agent holding means.

26. A developing apparatus as set forth in claim 24 or 25, further comprising an elastic plate used to scrape off the developing agent which has been transferred to said conductive roller.

27. A developing apparatus for developing a latent image by applying developing agent to a latent image holding body comprising:

developing agent holding means for holding a developing agent layer on its surface and which is movable;

developing agent supplying means for supplying the developing agent to said developing agent holding means, the developing agent supplying means being made to face said developing agent holding means with a gap therebetween; and means of forming an alternating electric field in the gap between said developing agent holding means and developing agent supplying means to deliver the developing agent from one to the other.

28. A developing apparatus as set forth in claim 27 in which said electric field forming means forms an AC electric field by an AC voltage on which a DC voltage is superimposed.

29. A developing apparatus for developing a latent image by applying developing agent to a latent image holding body comprising:

developing agent holding means for holding a developing agent layer on its surface and which is movable;

developing agent supplying means for supplying developing agent to said developing agent holding means and which is made to face said developing agent holding means with a gap therebetween;

means for forming an alternating electric field in the gap between said developing agent holding means and developing agent supplying means to deliver the developing agent from one to the other; and means for controlling the thickness of the developing agent layer on said developing agent holding means.

30. A developing apparatus as set forth in claim 13 in which said electric field forming means forms an AC electric field by an AC voltage to which a DC voltage is superimposed.

* * * * *